US009232865B2

(12) United States Patent
Trinh et al.

(10) Patent No.: US 9,232,865 B2
(45) Date of Patent: Jan. 12, 2016

(54) MULTI-CONFIGURABLE END DISPLAY

(71) Applicant: Target Brands, Inc., Minneapolis, MN (US)

(72) Inventors: Nick Q. Trinh, Minneapolis, MN (US); Daniel K. McDowell, Minneapolis, MN (US); Blake M. Johnson, St. Paul, MN (US)

(73) Assignee: Target Brands, Inc., Minneapolis, MN (US)

( * ) Notice: Subject to any disclaimer, the term of this patent is extended or adjusted under 35 U.S.C. 154(b) by 328 days.

(21) Appl. No.: 13/906,637

(22) Filed: May 31, 2013

(65) Prior Publication Data

US 2014/0353269 A1 Dec. 4, 2014

(51) Int. Cl.

| | |
|---|---|
| ***A47F 5/00*** | (2006.01) |
| ***A47F 5/10*** | (2006.01) |
| ***A47F 5/08*** | (2006.01) |

(52) U.S. Cl.

CPC ..... *A47F 5/10* (2013.01); *A47F 5/0807* (2013.01); *Y10T 29/49716* (2015.01)

(58) Field of Classification Search

CPC ..... A47F 5/10; A47F 5/13; A47F 5/108; A47F 5/135; A47F 5/0807; E04B 2/7431; G09F 15/00; B62B 2205/12; B62B 1/12; Y10T 16/541; Y10T 29/49716

USPC ..... 211/183, 190

See application file for complete search history.

(56) References Cited

U.S. PATENT DOCUMENTS

| | | | |
|---|---|---|---|
| 3,971,477 | A | 7/1976 | Bruderly et al. |
| 4,068,855 | A | 1/1978 | Hackett |
| 4,222,579 | A | 9/1980 | Frydendal |
| 4,444,322 | A | 4/1984 | Lee |
| 5,439,123 | A | 8/1995 | Nook |
| 5,445,280 | A | 8/1995 | Rahn |
| 5,573,124 | A | 11/1996 | Frost |
| 5,785,190 | A | 7/1998 | Otema |
| 5,918,750 | A | 7/1999 | Jackson |
| 6,062,402 | A | 5/2000 | Ford |
| 6,406,107 | B1 | 6/2002 | Franczak |
| 6,457,595 | B1 | 10/2002 | Pritchard et al. |
| 7,954,656 | B1 | 6/2011 | Cuzzocrea |
| 8,281,949 | B2 | 10/2012 | Scholen et al. |
| 2003/0173322 | A1 | 9/2003 | Rushing |
| 2004/0211741 | A1 | 10/2004 | Bustos et al. |
| 2004/0256341 | A1 | 12/2004 | Donnell et al. |
| 2006/0016774 | A1 | 1/2006 | Bustos |

OTHER PUBLICATIONS

Office Action from Canadian Patent Application No. 2,819,991, mailed Nov. 13, 2013 (2 pages).

*Primary Examiner* — Korie H Chan

(74) *Attorney, Agent, or Firm* — Leanne Taveggia Farrell Westman, Champlin & Koehler, P.A.

(57) ABSTRACT

An end display includes a base, an end panel coupled to a rear of the base, at least one channel mounted to the base and having an open top, a first wall panel and a spanner. The first wall panel is received by the at least one channel when the first wall panel is in a display position and is removed from the at least one channel when the first wall panel is in a storage position. The spanner is mounted to the end panel and includes at least one flange. The at least one flange has a first through hole for receiving a fastener that secures the first wall panel in the display position and a second through hole for receiving a fastener for securing at least the first wall panel in the storage position.

19 Claims, 9 Drawing Sheets

Fig. 9
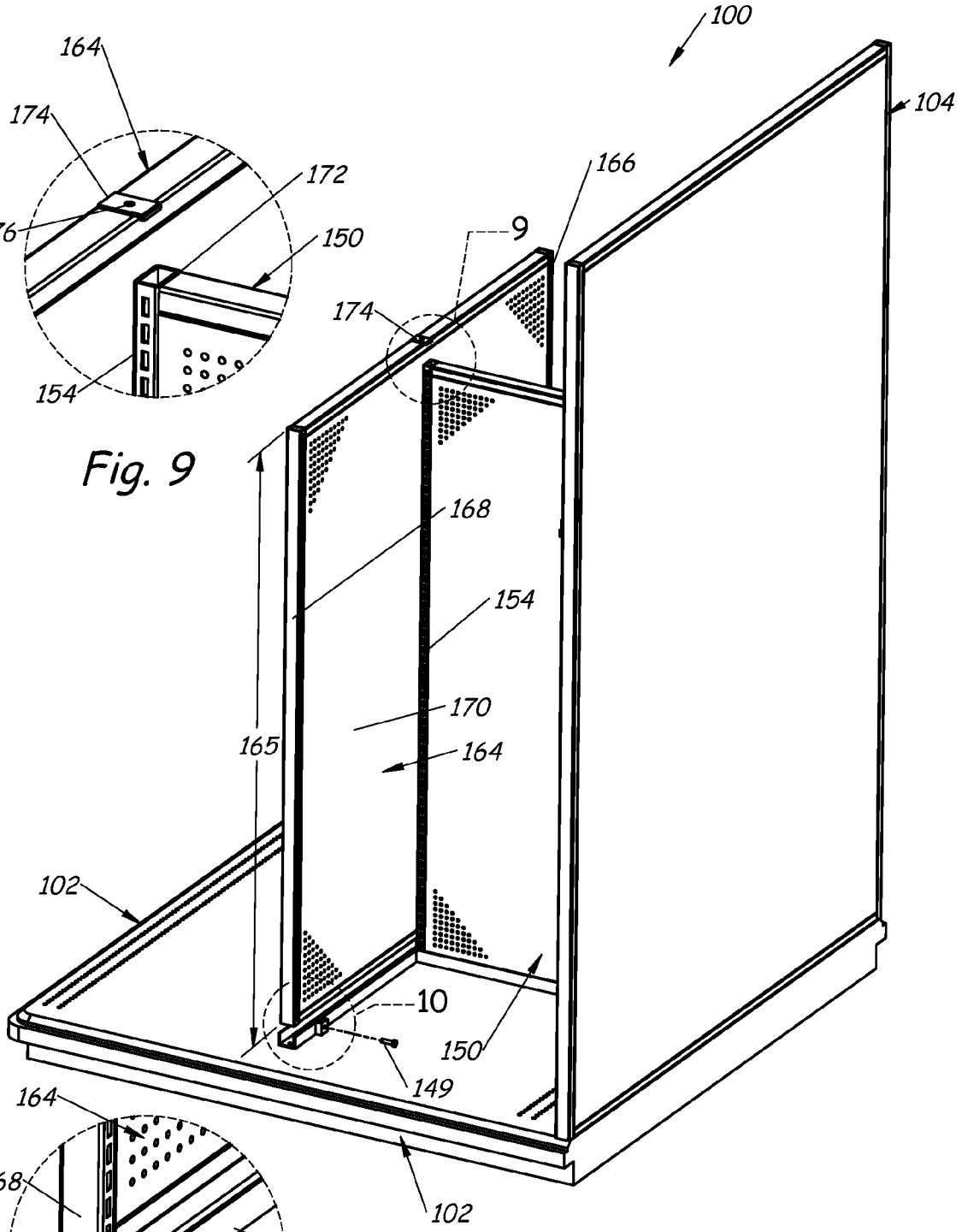
Fig. 8
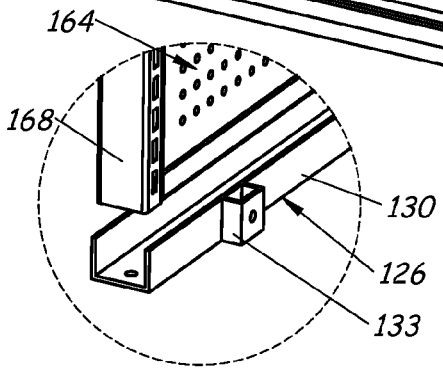
Fig. 10

MULTI-CONFIGURABLE END DISPLAY

BACKGROUND

Businesses, such as retail stores, use a variety of types of display structures to present products and related information to customers for purchase. An end cap is one type of display structure that displays product at an end of an aisle. Such products situated on an end cap often sell at a much faster pace than products not on an end cap.

The discussion above is merely provided for general background information and is not intended to be used as an aid in determining the scope of the claimed subject matter.

SUMMARY

An end display includes a base, an end panel coupled to a rear of the base, at least one channel mounted to the base and having an open top, a first wall panel and a spanner. The first wall panel is received by the at least one channel when the first wall panel is in a display position and is removed from the at least one channel when the first wall panel is in a storage position. The spanner is mounted to the end panel and includes at least one flange. The at least one flange has a first through hole for receiving a fastener that secures the first wall panel in the display position and a second through hole for receiving a fastener for securing at least the first wall panel in the storage position.

The end panel has a pair of uprights and a back wall extending between the pair of uprights. The first wall panel has a pair of uprights and a wall member extending between the pair of uprights. A second wall panel has a pair of uprights and a wall member extending between the pair of uprights. In a first display configuration, the first wall member is mounted to the base such that the wall member of the first wall panel is substantially perpendicular to the back wall of the end panel. In the first display configuration, the second wall panel is mounted to the base such that the wall member of the second wall panel abuts with one of the pair of uprights of the first wall panel and the wall member of the second wall panel is oriented substantially perpendicular to the wall member of the first wall panel. In a second display configuration, the first wall panel and the second wall panel are positioned adjacent to each other such that the wall member of the first wall panel and the wall member of the second wall panel are in substantially parallel orientations and are secured to the back wall of the end panel.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

FIG. 8 is a back perspective view of another step in configuring the end display illustrated in FIG. 1 into the first display configuration illustrated in FIG. 5.

FIG. 9 is an enlarged view of a portion of FIG. 8.

FIG. 10 is an enlarged view of another portion of FIG. 8.

DETAILED DESCRIPTION

In a business or a retail store, display structures are used to display products or merchandise. An end display or end cap is one type of display structure that displays merchandise at an end of an aisle. Merchandise situated on an end display often sells at a much faster pace than merchandise that is not. Since real estate on an end display is highly desirable, the ability to quickly change the layout or configuration of an end display to accommodate different types of products is important.

The end display described in detail below is configurable into multiple different display configurations. In a first display configuration, products are displayed on the end display so that they are viewable from one of three directions. In a second display configuration, products are displayed so that they are simultaneously viewable from all three directions.

Figure 1:
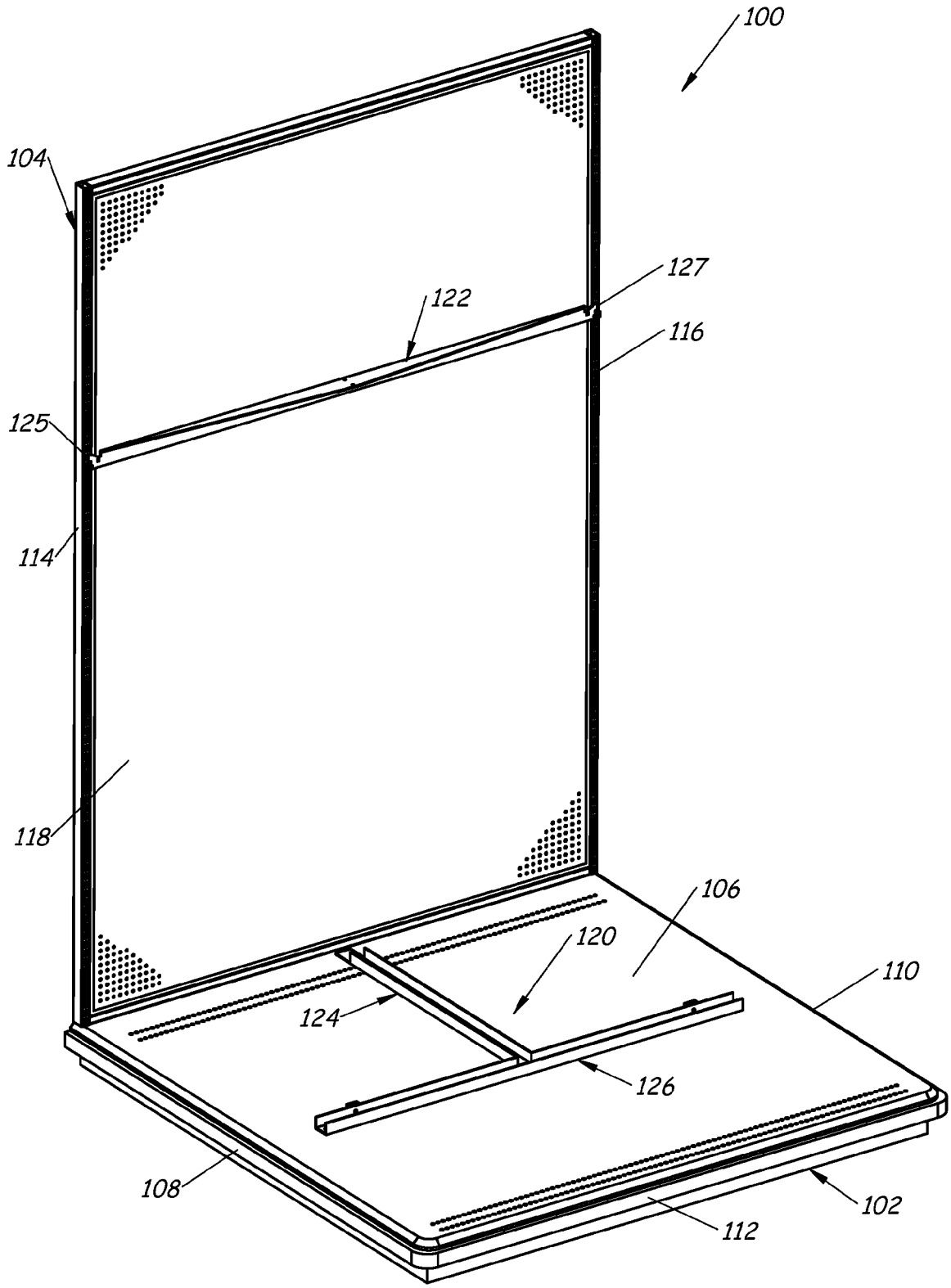
FIG. 1 is a front perspective view of an end display that is configurable into multiple display configurations according to one embodiment.

FIG. 1 is a front perspective view of an end display 100 that is configurable into multiple display configurations according to one embodiment. While end display 100 can be any type of structure that exists at an end of an aisle in a business or retail store, in one embodiment and as illustrated, end display 100 is a gondola. A gondola is a freestanding display fixture used to display products and merchandise. Gondolas include flat, substantially horizontal bases or base decks and a substantially vertical back wall supported by a pair of slotted uprights. The substantially vertical back wall can feature notches, pegboards and/or slat walls. In addition, the vertical back wall can be fitted with shelves, peg hooks or other display components. Gondolas placed side-by-side form rows that define aisles. In the embodiments described herein, the vertical back wall of a gondola that is placed at an end of a row of side-by-side gondolas is oriented substantially perpendicular to the vertical back walls of the side-by-side gondolas to be used as an end display or end cap.

End display 100 includes an end deck 102 (e.g., a base deck or base of a gondola) and an end frame or end panel 104 (e.g., a back wall supported by a pair of uprights of a gondola). End deck 102 includes a substantially flat, horizontal base 106 defined by a pair of opposing sides 108 and 110 and an end 112. When products displayed on end display 100 face the left side, they are facing side 108. When products displayed on end display 100 face the right side, they are facing side 110. When products displayed on end display 100 face the front, they are facing end 112. Coupled to a rear of end deck 102, which is opposite end 112, is end frame 104. End frame 104 is a substantially vertical wall that includes a pair of uprights or upright standards 114 and 116 that support a back wall 118. In the embodiment illustrated in FIG. 1, back wall 118 is illustrated as having fragmented depictions of a pattern of holes. It should be understood that in this embodiment these fragmented depictions of holes repeat throughout back wall 118, such as like a pegboard.

Figure 2:
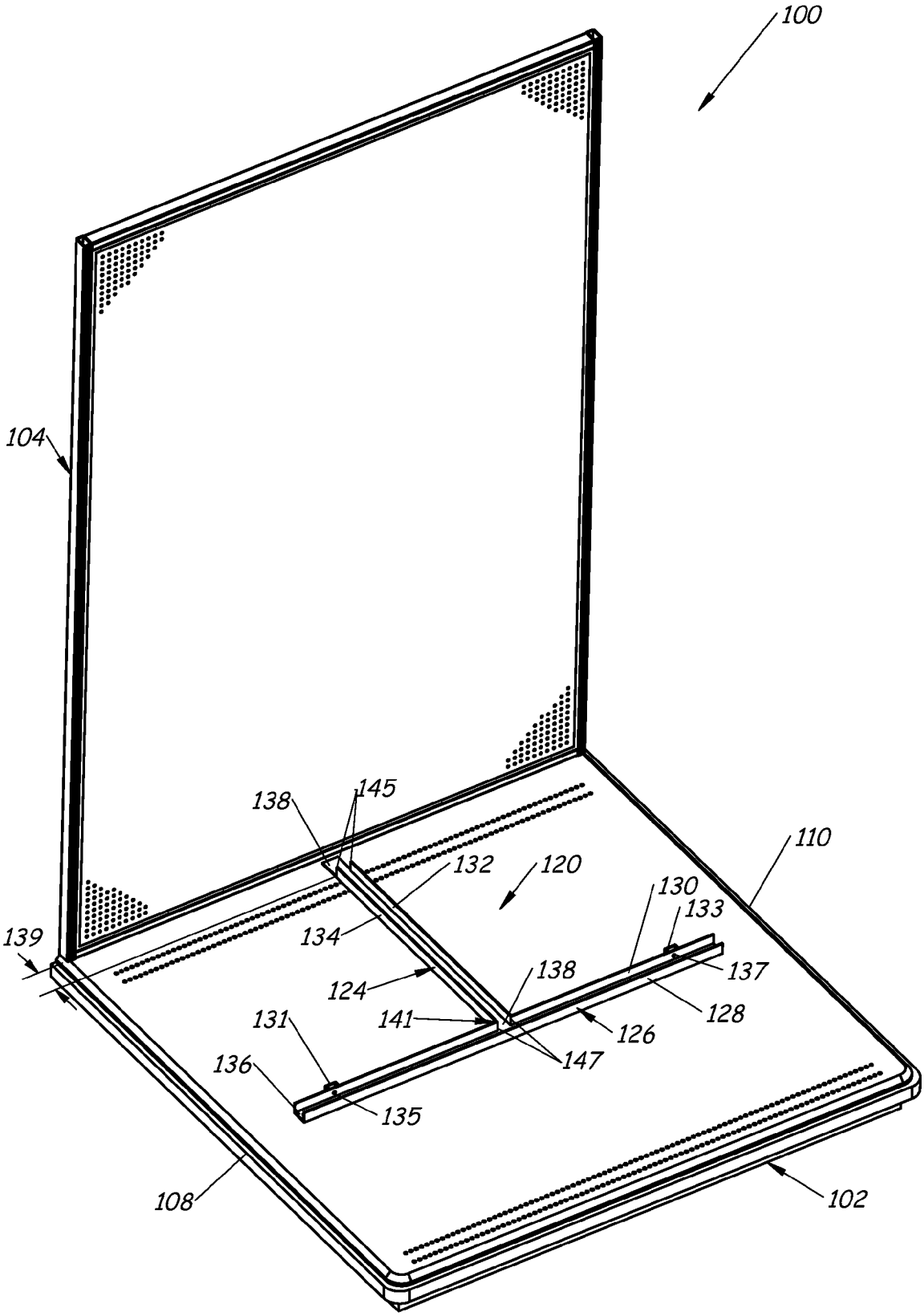
FIG. 2 is a front perspective view of the end display illustrated in FIG. 1 undergoing an installation step.
Figures 3, 4:
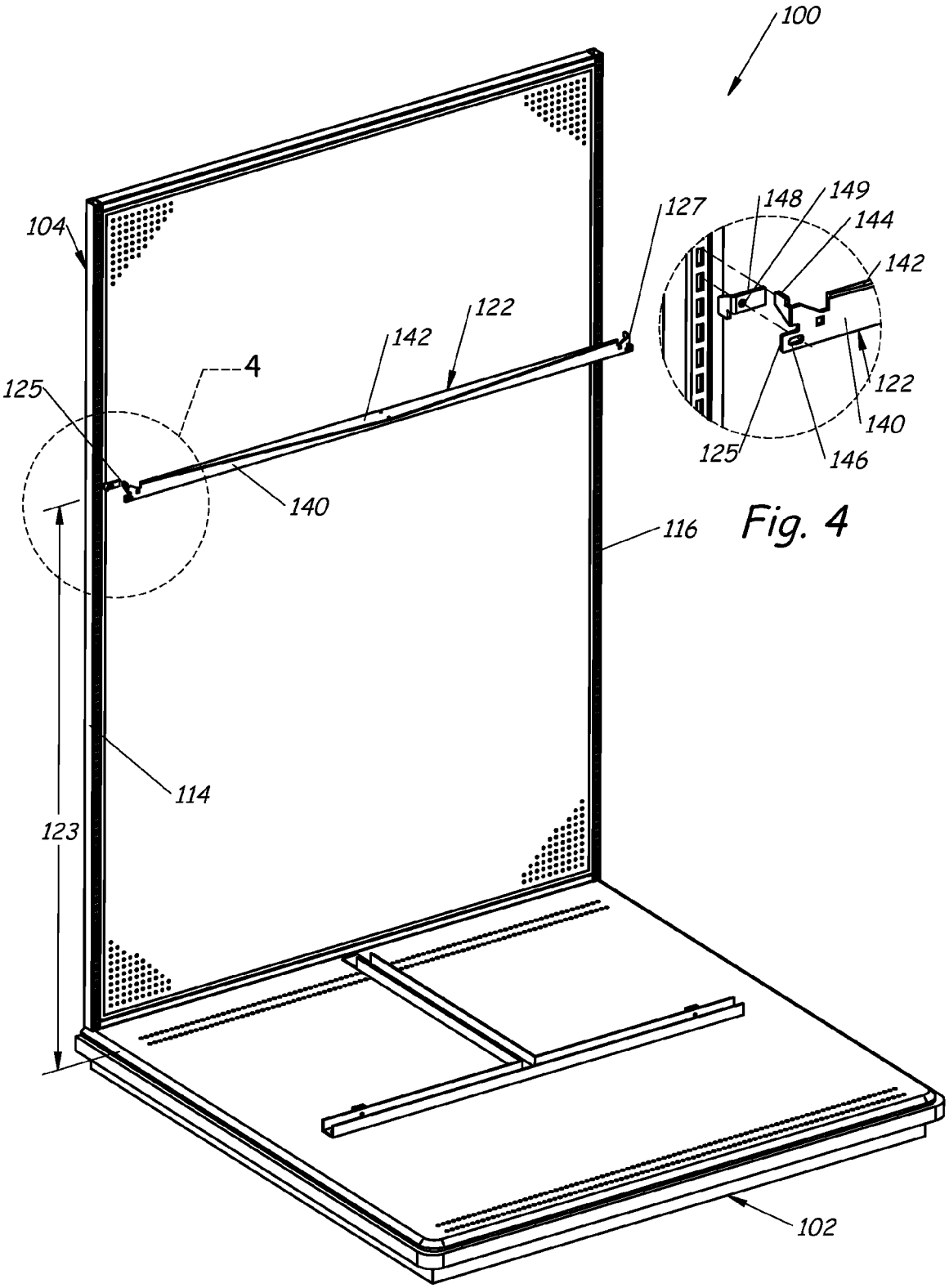
FIG. 3 is a front perspective view of the end display illustrated in FIG. 1 undergoing an installation step.
FIG. 4 is an enlarged view of a portion of the installation step illustrated in FIG. 3.

To configure end display 100 into multiple different display configurations, end display 100 includes a frame mount 120 and a spanner or cross support 122. Frame mount 120 includes a first elongated channel 124 and a second elongated channel 126 that are mounted to base 106 of end deck 102. Spanner 122 extends across end frame 104 and includes a first end 125 coupled to upright 114 and a second end 127 coupled to upright 116. After the installation of frame mount 120 and spanner 122, end display 100 can be configured into multiple different display configurations, which allows products to be viewed from one of three directions as will be described in a first display configuration or allows products to be simultaneously viewed from all three directions as will be described in a second display configuration. FIGS. 2-4 illustrate the installation of frame mount 120 and spanner 122 and such installation of these components is described in detail below.

FIG. 2 is a front perspective view of end display 100 illustrated in FIG. 1 undergoing an installation step. In the step illustrated in FIG. 2, intersecting first elongated channel 124 and second elongated channel 126 of frame mount 120 are positioned on and secured to base 106 of end deck 102. First channel 124 is defined by a pair of opposing sides 132 and 134 coupled together by a bottom 138 and includes an open top. Second channel 126 is defined by a pair of opposing sides 128 and 130 coupled together by a bottom 136 and includes an open top. The pair of opposing sides 132 and 134 of first channel 124 are configured to receive a first wall panel in a display position and the pair of opposing sides 128 and 130 of second channel 126 are configured to receive a second wall panel in a display position.

Although opposing sides 132 and 134 of first channel 124 are continuous and uninterrupted and terminate at ends that are substantially equally aligned, one end of bottom 138 extends beyond first ends 145 of opposing sides 132 and 134, while the opposing end of bottom 138 terminates at second ends 147 of opposing sides 132 and 134 so that bottom 138 is substantially equally aligned with opposing sides 132 and 134. In other words, first ends 145 of opposing sides 132 and 134 are spaced apart from back wall 118 of end frame 104 by a distance 139 and second ends 147 abut opposing side 130 of second channel 126. When first channel 124 is positioned on base 106, the opposing sides 132 and 134 of first channel 124 are oriented substantially perpendicular to back wall 118 of end frame 104 and the protruding end of bottom 138 is located proximal to end frame 104.

The opposing sides 128 and 130 of second channel 126 are oriented substantially perpendicular to opposing sides 132 and 134 of first channel 124. Although side 128 of second channel 126 is continuous and uninterrupted, opposing side 130 of second channel 126 has a discontinuous section 141 that aligns with the pair of opposing sides 132 and 134 of first channel 124. In this way, bottom 138 of first channel 124 communicates with or connects to bottom 136 of second channel 126 at discontinuous section 141 of second channel 126 so that when second channel 126 receives a second wall panel in the display position the second wall panel abuts with and is substantially perpendicular to the first wall panel received by first channel 124 in the display position.

Including discontinuous section 141 of side 130, the pair of opposing sides 128 and 130 and the bottom 136 of second channel 126 all include substantially the same lengths such that they have terminating ends that are substantially equally aligned. In addition, side 130 of second channel 126 includes a pair of brackets 131 and 133 centered over a pair of holes 135 and 137 that extend through side 130. Brackets 131 and 133 and holes 135 and 137 are located on either side of discontinuous section 141 of side 130 and protrude rearward from channel 126. Brackets 131 and 133 and holes 135 and 137 are configured to receive fasteners for mounting components to second channel 126 that will be discussed in detail below.

As illustrated in FIG. 2, frame mount 120 is t-shaped and is centered on base 106 of end deck 102 so that the end of bottom 138 that extends beyond the terminating ends of opposing sides 132 and 134 of first channel 124 are located in a position that is centered on end frame 104 and the terminating ends of opposing sides 128 and 130 and bottom 136 of second channel 126 are located at substantially equal distances from opposing sides 108 and 110 of end deck 102. First channel 124 and second channel 126 are secured to base 106 of end deck 102 using a plurality of fasteners that extend through bottoms 136 and 138. More particularly, fasteners can be placed proximate to the terminating end of bottom 138 of first channel 124 that is located proximate to end frame 104 and proximate to the terminating ends of bottom 136 of second channel 126.

FIG. 3 is a front perspective view of end display 100 illustrated in FIG. 1 undergoing an installation step. In the step illustrated in FIG. 3, ends 125 and 127 of spanner 122 are mounted to uprights 114 and 116 of end frame 104 at a height 123 relative to a bottom of end frame 104 or a base 106 of end deck 102. Spanner 122 includes a substantially vertical component or flange 140 and a substantially horizontal component or flange 142. Substantially vertical component 140 includes ends 125 and 127 that are mounted to uprights 114 and 116. Substantially horizontal component 142 includes a depth that is greater at the center of spanner 122 than at the ends of substantially horizontal component 142. When spanner 122 is mounted to uprights 114 and 116, the depth of substantially horizontal component 142 extends from substantially vertical component 140 towards end 112 of end deck 102.

FIG. 4 is an enlarged view of a portion of the installation step illustrated in FIG. 3. More specifically, FIG. 4 is an enlarged view of left end 125 of spanner 122 being mounted to upright standard 114 of end frame 104. It should be understood that right end 127 of spanner 122 mirrors left end 125 of spanner 122. Each end 125 and 127 of spanner 122 includes a spanner hook (only left end spanner hook 144 is illustrated in FIG. 4) that is oriented substantially perpendicular to substantially vertical component 140 and a spanner aperture (only left end spanner aperture 146 is illustrated in FIG. 4).

To mount spanner 122 to end frame 104, left end spanner hook 144 is inserted into a slot in upright standard 114 and a right end spanner hook is inserted into a slot in upright standard 116. Each of left end spanner hook 114 and the right end spanner hook is tilted into a corresponding slot on the corresponding upright standard. In the slot in upright standard 114 that is directly below the slot to which left end spanner hook 144 was inserted is inserted a left end hook locking clip 148 having a receiving hole 149. In the slot in upright standard 116 that is directly below the slot to which the right end spanner hook was inserted is inserted a right end hook locking clip having a receiving hole. Left end spanner aperture 146 located in substantially vertical component 140 is aligned with receiving hole 149 in left end hook locking clip 148 and receives a fastener for fastening substantially vertical component 140 to left end hook locking clip 148. Likewise, a right end spanner aperture (not shown) in substantially vertical component 140 is aligned with the receiving hole in the right end hook locking clip and receives a fastener for fastening substantially vertical component 140 to the right end hook locking clip.

Figure 5:
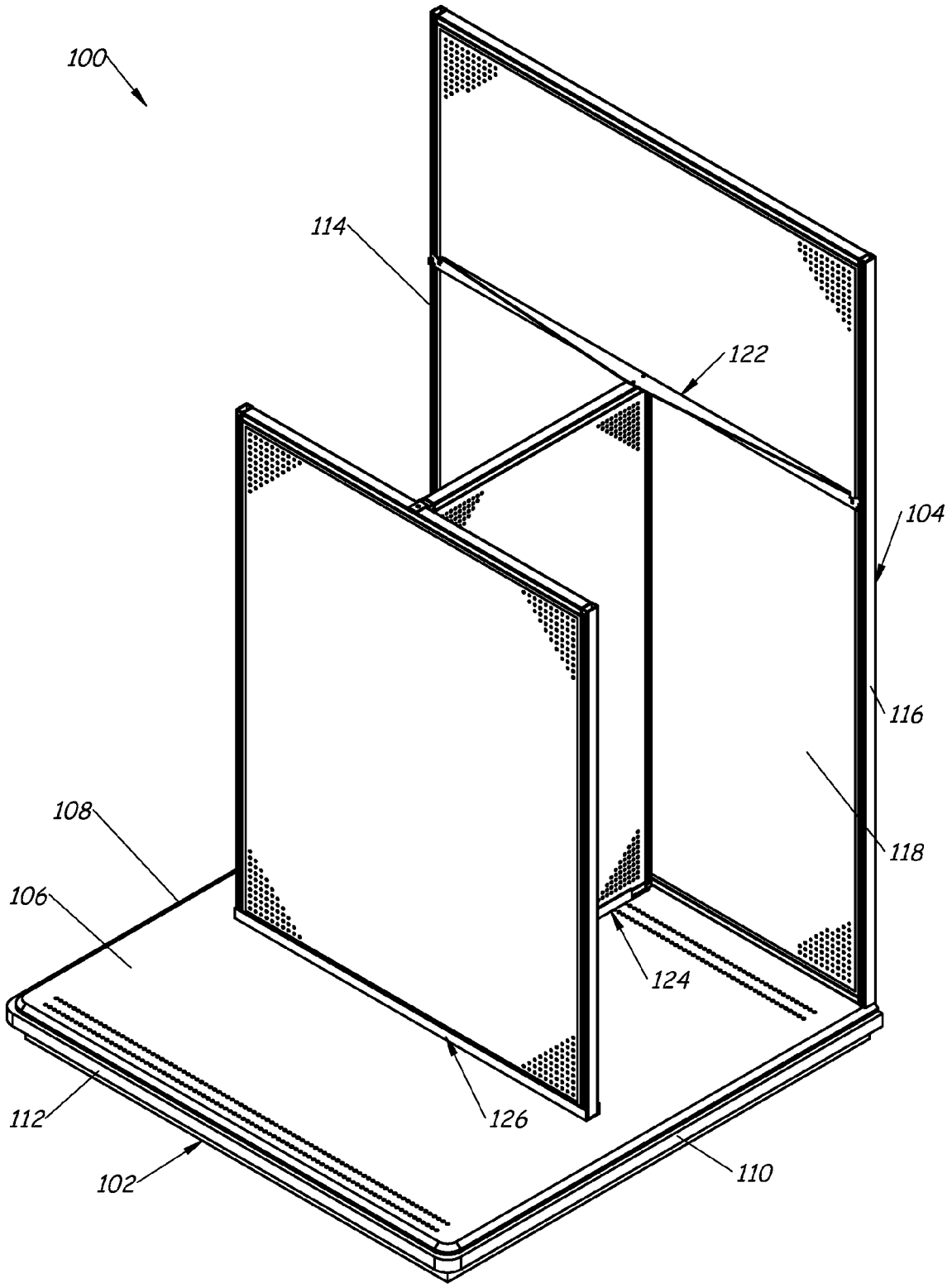
FIG. 5 is a front perspective view of the end display illustrated in FIG. 1 in a first display configuration according to one embodiment.

FIG. 5 is a front perspective view of the end display illustrated in FIG. 1 in a first display configuration according to one embodiment. The first display configuration provides a way for products to be displayed on end display 100 so that they are viewable from one of three different directions (i.e., viewable from right side 108, left side 110 or end 112).

Figures 6, 7:
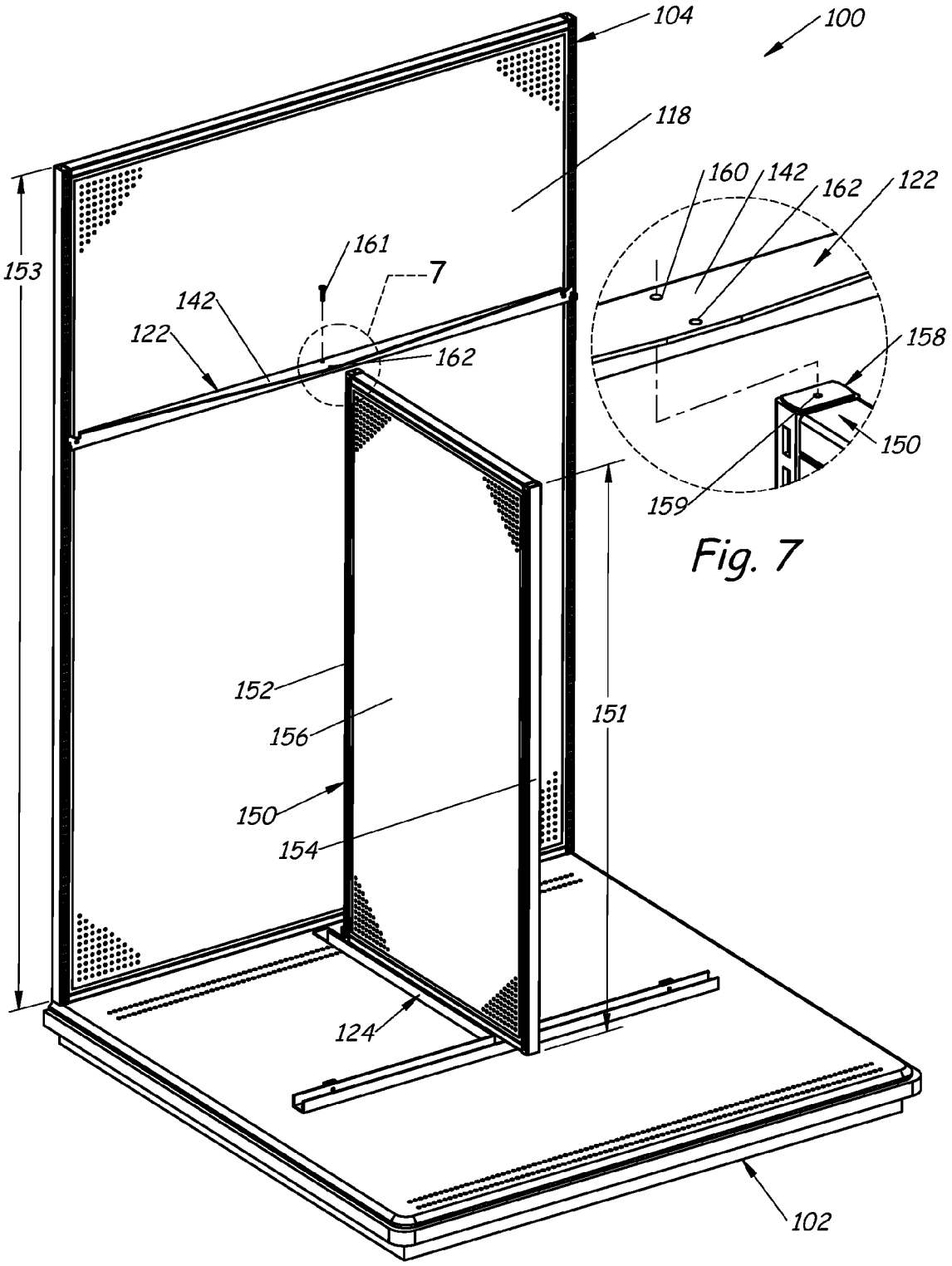
FIG. 6 is a front perspective view of a step in configuring the end display illustrated in FIG. 1 into the first display configuration illustrated in FIG. 5.
FIG. 7 is an enlarged view of a portion of FIG. 6.

FIG. 6 is a front perspective view of a step in configuring the end display illustrated in FIG. 1 into the first display configuration illustrated in FIG. 5. In the step illustrated in FIG. 6, a first in-line frame or first wall panel 150 is mounted to end display 100. More specifically, first channel 124 receives a bottom of first in-line frame 150 and a top of first in-line frame 150 is secured to spanner 122 so as to place first in-line frame 150 in a display position. First in-line frame or first wall panel 150 is a substantially vertical wall component that has a height 151 that is less than a height 153 of end frame 104. First in-line frame 150 includes a pair of upright standards 152 and 154 that support a wall or wall member 156. In the embodiment illustrated in FIG. 6, wall or wall member 156 is illustrated as having fragmented depictions of a pattern of holes. It should be understood that in this embodiment these fragmented depictions of holes repeat throughout wall 156, such as like a pegboard. When inserting first in-line frame 150 into first channel 124, upright standard 152 should abut substantially vertical component or flange 140 of spanner 122 so that first in-line frame 150 or wall 156 of in-line frame 150 is oriented substantially perpendicular to end frame 104 or back wall 118 of end frame 104.

FIG. 7 is an enlarged view of a portion of FIG. 6 illustrating the securing of first in-line frame 150 to spanner 122. As illustrated in FIG. 7, a top of upright standard 152 includes a weldnut 158. Weldnut 158 includes a threaded hole 159 for receiving a fastener. As also illustrated in FIG. 7, substantially horizontal component or flange 142 of spanner 122 includes a first through hole 160 for receiving a fastener and a second through hole 162 for receiving a fastener. First through hole 160 and second through hole 162 are located at the center of spanner 122 where the depth of substantially horizontal component 142 is the greatest. First through hole 160 and second through hole 162 are spaced apart from each other so that first through hole 160 is proximal to end frame 104 and second through hole 162 is distal to end frame 104. When positioning first in-line frame 150, threaded hole 159 is aligned with first through hole 160 in spanner 122 so that threaded hole 159 and first through hole 160 receive a fastener 161 (FIG. 6) to secure first in-line frame 150 to spanner 122 in the display position.

FIG. 8 is a back perspective view of another step in configuring the end display illustrated in FIG. 1 into the first display configuration illustrated in FIG. 5. In the step illustrated in FIG. 8, a second in-line frame or second wall panel 164 is mounted to end display 100. More specifically, second channel 126 receives a bottom of second in-line frame 164 and a top of second in-line frame 164 is secured to first in-line frame 150 so as to place second in-line frame 164 in a display position. Second in-line frame or second wall panel 164 is a substantially vertical wall component that has a height 165 that is less than height 153 of end frame 104 and is substantially equal to height 151 of first in-line frame 150. Second in-line frame 164 includes a pair of upright standards 166 and 168 that support a wall or wall member 170. In one embodiment illustrated in FIG. 8, wall or wall member 170 is illustrated as having fragmented depictions of a pattern of holes. It should be understood that in this embodiment these fragmented depictions of holes repeat throughout wall 170, such as like a pegboard.

When inserting second in-line frame 164 into second channel 126, the bottom of second in-line frame 164 should extend between ends of the opposing side walls 128 and 130 of second channel 126 so that second in-line frame 164 or wall 170 of second in-line frame 164 is oriented substantially perpendicular to first in-line frame 150 or wall 156 of first in-line frame 150. In addition, wall member 170 of second in-line frame 164 abuts upright 154 of first in-line frame member 150.

FIG. 9 is an enlarged view of a portion of FIG. 8 illustrating the securing of second in-line frame 164 to first in-line frame 150. As illustrated in FIG. 9, a top of upright standard 154 of first in-line frame 150 includes an open end 172. For example, upright standard 154 is a hollow frame member that is open-ended on both the top and bottom of upright standard 154. Second in-line frame 164 includes a fastener or central hook 174 affixed to its top. When lowering second in-line frame 164 into second channel 126, central hook 174 is aligned with and inserted into open end 172 in upright standard 154 such that a front of central hook 174 is in contact with an inner surface of upright standard 154.

FIG. 10 is an enlarged view of another portion of FIG. 8 illustrating the further securing of second in-line frame 164. As previously discussed above in regards to FIG. 3, side 130 of second channel 126 includes a pair of brackets 131 and 133 centered over a pair of holes 135 and 137 that extend through side 130 of second channel 126. Brackets 131 and 133 and holes 135 and 137 are located on either side of the discontinuous section 141 of side 130 and protrude rearward from channel 126. Although FIG. 10 only illustrates bracket 133, each of brackets 131 and 133 and holes 135 and 137 are configured to receive a fastener, such as a fastener 149 (FIG. 8), to secure second in-line frame 164 to end deck 102 or second channel 126 by pressing against second din-line frame 164. After second in-line frame 164 is secured to end display 100, end display 100 is configured into its first display configuration.

Figure 11:
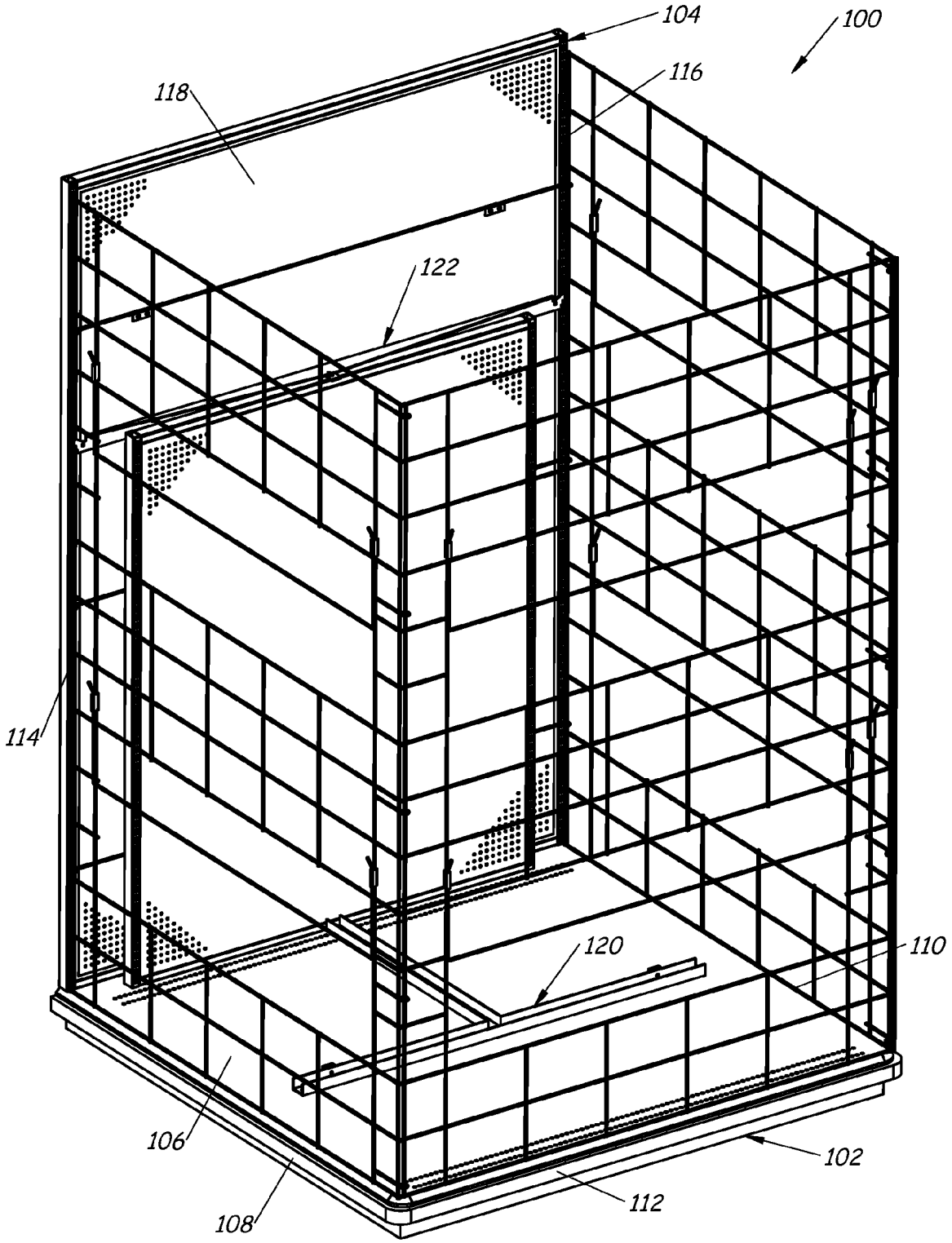
FIG. 11 is a front perspective view of the end display illustrated in FIG. 1 in a second display configuration according to one embodiment.

FIG. 11 is a front perspective view of the end display illustrated in FIG. 1 in a second display configuration according to one embodiment. The second display configuration provides a way for products to be displayed on end display 100 so that they are simultaneously viewable from all three directions (i.e., viewable from right side 108, left side 110 and end 112).

Figure 12:
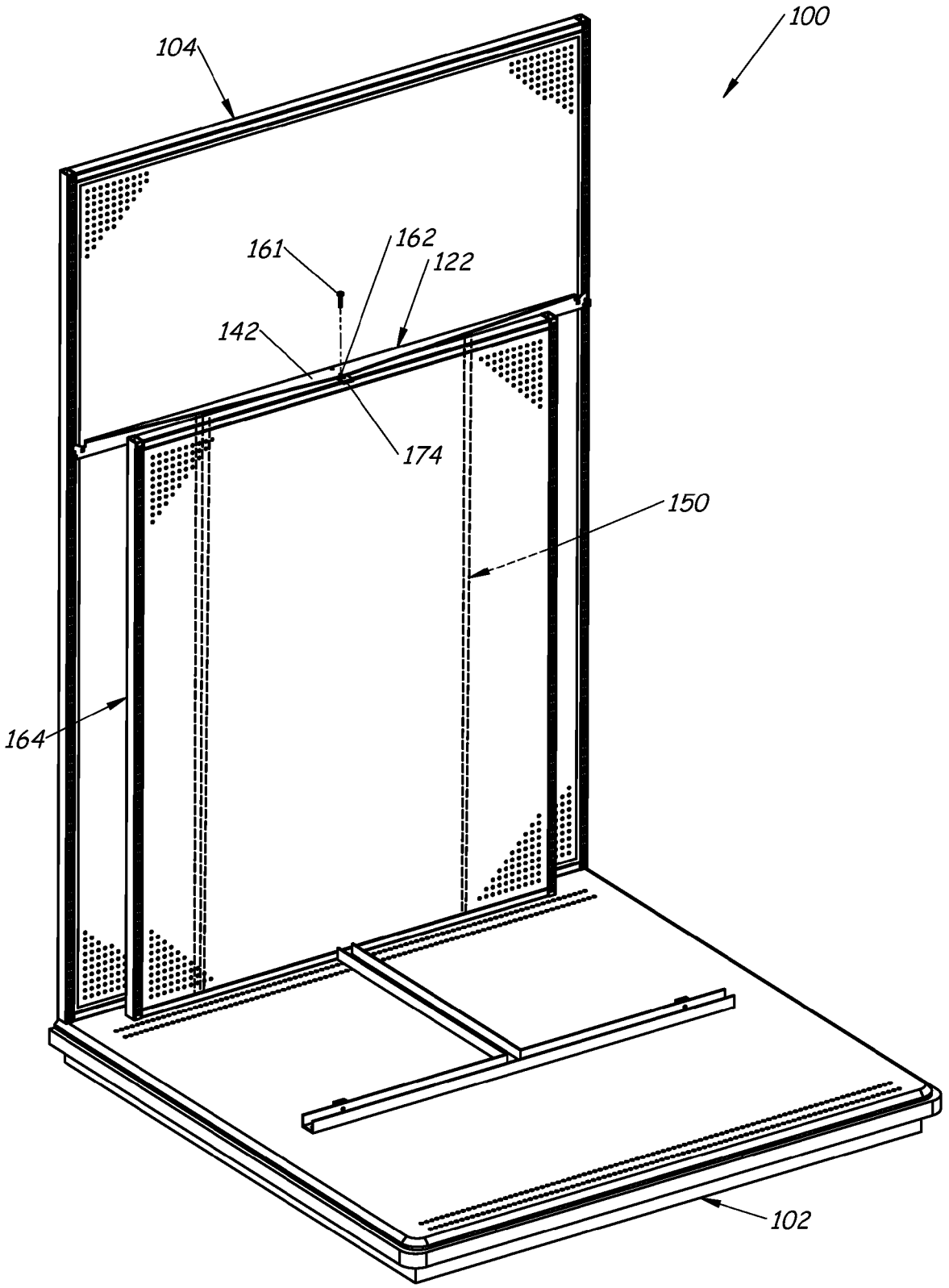
FIG. 12 is a front perspective view of a step in configuring the end display illustrated in FIG. 1 into the second display configuration illustrated in FIG. 11.

FIG. 12 is a front perspective view of a step in configuring the end display illustrated in FIG. 1 into the second display configuration illustrated in FIG. 11. In the step illustrated in FIG. 12, first in-line frame 150 and second in-line frame 164 are removed from frame mount 120 and are secured to back wall 118 of end frame 104. More specifically, second in-line frame 164 is detached from upright 154 of first in-line frame 150 and removed from second channel 126 of frame mount 120 and upright 152 of first in-line frame 150 is detached from spanner 122 and removed from first channel 124 of frame mount 120. Then, first in-line frame 150 and second in-line frame 164 are placed in a storage position adjacent to wall member 118 of end frame 104.

As illustrated in FIG. 12 and in a storage position, first in-line frame 150 (illustrated in phantom lines) and second in-line frame 164 are stacked or positioned adjacent to each other such that wall member 156 of first in-line frame 150 and wall member 170 of second in-line frame are in substantially parallel orientations with each other and in substantially parallel orientation with wall member 118 of end frame 104. For example, first in-line frame 150 and second in-line frame 164 are placed between first ends 145 of opposing sides 132 and 134 of first channel 124 and back wall 118 of end frame 104. First in-line frame 150 and second in-line frame 164 are secured in the storage position by fastening a top of second in-line frame 164 to substantially horizontal component 142. More specifically, first in-line frame 150 and second in-line frame 164 are secured in the storage position by aligning a hole 176 (illustrated in FIG. 9) in fastener or central hook 174 of second in-line frame 164 with second hole 162 in substantially horizontal component 142 of spanner 122. A fastener is inserted through second hole 162 in spanner 122 and hole 176 in central hook 174 of second in-line frame 164 to secure first in-line frame 150 and second in-frame 164 to end frame 104 and therefore end display 100. For example, fastener 161 that was inserted through first hole 160 in substantially horizontal component 142 of spanner 122 and through threaded hole 159 in weldnut 158 of upright standard 152 for securing first in-line frame 150 in the first display configuration can be reused to secure first in-line frame 150 and second in-line frame 164 in a storage position in the second display configuration.

Figure 13:
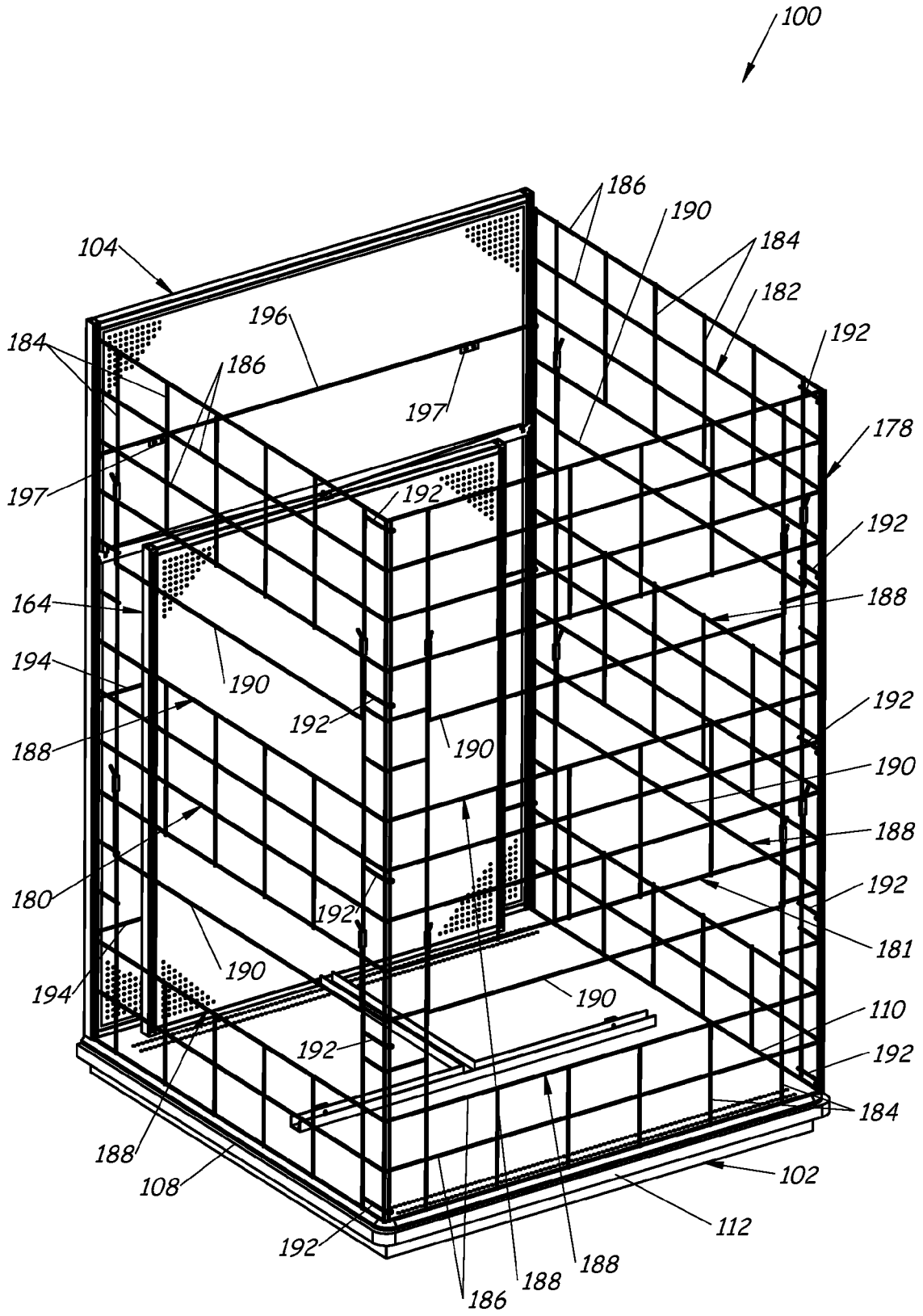
FIG. 13 is a front perspective view of another step in configuring the end display illustrated in FIG. 1 into the second display configuration illustrated in FIG. 11.

FIG. 13 is a front perspective view of another step in configuring the end display illustrated in FIG. 1 into the second display configuration illustrated in FIG. 11. In the step illustrated in FIG. 13, a cage fixture 178 is mounted to end display 100. Cage fixture 178 retains merchandise, such as play balls, so that the merchandise can be viewed from the left, the right and the front of end display 100. It should be realized, however, that other types of fixtures besides cage fixture 178 providing the same viewing capability could be used.

Cage fixture 178 includes three side panels 180, 181 and 182 each having a plurality of substantially horizontal members 184 and a plurality of substantially vertical member 186 that intersect with the substantially horizontal member 184. First side panel 180 is positioned on left side 108 of end deck 102, second side panel 181 is positioned on end 112 of end deck 102 and third side panel 182 is positioned on right side 110 of end deck 102. While the substantially horizontal and vertical members 184 and 186 of each of side panels 180, 181 and 182 intersect at distances that prevent merchandise from falling outside of cage fixture 178, each of side panels 180, 181 and 182 include openings 188 for accessing that are large enough to remove merchandise but include adjustable members 190 for preventing merchandise from being accessed. Cage fixture 178 also includes a plurality of pins 192 that couple first side panel 180 to second side panel 181 and second side panel 181 to third side panel 182 as well as a pair of lower rear cross supports 194 and an upper rear cross support 196 for coupling first side panel 180 to third side panel 182. All of the components of cage fixture 178 can be preassembled together and the cage fixture 178 can be folded down for storage.

To mount cage fixture 178 to end cap display fixture 100, lower rear cross supports 194 are removed from cage fixture 178. Then, cage fixture 178 is set onto or stood on top of end deck 102 of end display 100 as illustrated in FIG. 12 so that cage fixture 178 is pushed all the way back, centered on end deck 102 and first side panel 180 extends along right side 108 of end deck 102, second side panel 181 extends along end 112 of end deck 102 and third side panel 182 extends along left side 110 of end deck 102. Flanges 197 located on upper cross support 196 are secured to back wall 118 of end frame 104 using fasteners. Finally, the pair of lower rear cross supports 194 are fed between end frame 104 and first in-line frame 150, which is located behind second in-line frame 164 and secured to first side panel 180 and third side panel 182 as shown. After first in-line frame 150 and second in-line frame 164 are secured in a storage position and after cage fixture 178 is mounted to end display 100, end display 100 is configured into its second configuration.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An end display comprising:

a base;

an end panel coupled to a rear of the base;

at least one channel mounted to the base and having an open top;

a first wall panel that is received by the at least one channel when the first wall panel is in a display position and is removed from the at least one channel when the first wall panel is in a storage position;

a spanner mounted to the end panel and including at least one flange, the at least one flange having a first through hole for receiving a fastener that secures the first wall panel in the display position and a second through hole for receiving a fastener for securing at least the first wall panel in the storage position.

2. The end display of claim 1, wherein in the display position the first wall panel is oriented substantially perpendicular to the end panel.

3. The end display of claim 1, wherein the at least one channel that is mounted to the base comprises a first channel having a pair of a opposing sides that receive the first wall panel in the display position and a second channel having a pair of opposing sides that receive a second wall panel in the display position, wherein the opposing sides of the first channel are oriented substantially perpendicular to the end panel and the opposing sides of the second channel are oriented substantially perpendicular to the opposing sides of the first channel.

4. The end display of claim 3, wherein one of the pair of opposing sides of the second channel comprises a discontinuous section, wherein the discontinuous section is aligned with the pair of opposing sides of the first channel so that when the second channel receives a second wall panel in the display position, the second wall panel abuts with and is substantially perpendicular to the first wall panel in the display position.

5. The end display of claim 4, wherein the opposing sides of the first channel comprise first ends and second ends, the first ends being spaced apart from the end panel by a distance and the second ends abutting the opposing side of the second channel that has the discontinuous section.

6. The end display of claim 5, wherein when the first wall panel is in the storage position the first wall panel is oriented substantially perpendicular to the first channel and is located between the first ends of the opposing sides of the first channel and the end panel.

7. The end display of claim 6, wherein when the second wall panel is in the storage position the second wall panel is oriented substantially perpendicular to the first channel and is located between the first ends of the opposing sides of the first channel and the first wall panel.

8. The end display of claim 7, wherein the fastener that uses the second through hole in the spanner to secure at least the first wall panel in the storage position engages with the second wall panel to secure the second wall panel and the first wall panel in the storage position.

9. An end cap comprising:

an end deck;

an end frame coupled to a rear of the end deck and having a pair of uprights and a back wall extending between the pair of uprights;

a cross support having at least one flange, a first end and an opposing second end, wherein the first end is mounted to one of the pair of uprights of the end frame and the second end is mounted to the other of the pair of uprights of the end frame so the cross support extends across the back wall of the end frame;

a first in-line frame having first and second uprights and a wall member extending between the first and second uprights of the first in-line frame, wherein in a first display configuration the first in-line frame is mounted to the end deck such that a top of the first upright of the first in-line frame fastens to the at least one flange of the cross support and the wall member of the first in-line frame is substantially perpendicular to the back wall of the end frame;

a second in-line frame having first and second uprights and a wall member extending between the first and second uprights of the second in-line frame, wherein in the first display configuration the second in-line frame is mounted to the end deck such that the wall member of the second in-line frame abuts with the second upright of the first in-line frame and the wall member of the second in-line frame is oriented substantially perpendicular to the wall member of the first in-line frame;

wherein in a second display configuration the top of the first in-line frame is free from the at least one flange, the first in-line frame member is positioned adjacent to the second in-line frame such that the wall member of the first in-line frame and the wall member of the second in-line frame are in substantially parallel orientations and the first in-line frame and the second in-line frame are secured to the back wall of the end frame by fastening a top of the second in-line frame to the at least one flange of the cross support.

10. The end cap of claim 9, wherein the at least one flange of the cross support comprises a depth that is greater at a center of the at least one flange than at ends of the at least one flange.

11. The end cap of claim 9, wherein the top of the second in-line frame comprises a fastener that attaches to an open end of the second upright of the first in-line frame.

12. The end cap of claim 9, further comprising a first channel mounted to the end deck and configured to receive and attach a bottom of the first in-line frame to the end deck, the first channel being oriented substantially perpendicular to the back wall of the end frame.

13. The end cap of claim 12, further comprising a second channel mounted to the end deck and configured to receive and attach a bottom of the second in-line frame to the end deck, the second channel being oriented substantially perpendicular to the first channel.

14. The end cap of claim 9, wherein the first in-line frame and the second in-line frame include a height that is less than a height of the end frame.

15. A method of configuring an end display, the method comprising:

configuring an end display having an end frame attached to a rear of an end deck into a first display configuration by:

mounting a first wall panel to an end deck by inserting a bottom of the first wall panel into a first elongated channel and securing an end of the first wall panel to a spanner on the end frame, the first elongated channel being oriented substantially perpendicular to a wall of the end frame; and mounting a second wall panel to the end deck by inserting a bottom of the second wall panel into a second elongated channel and securing the second wall panel to an opposing end of the first wall panel, the second elongated channel being oriented substantially perpendicular to the first elongated channel.

16. The method of claim 15, further comprising:

configuring the end display into a second display configuration by:

detaching the second wall panel from the opposing end of the first wall panel;

detaching the end of the first wall panel from the spanner; and storing the first wall panel and the second wall panel adjacent to the end frame.

17. The method of claim 16, wherein storing the first wall panel and the second wall panel adjacent to the end frame comprises:

orienting the first wall panel and the second wall panel substantially parallel to each other and substantially parallel to the wall of the end frame; and positioning the first wall panel and the second wall panel between an end of the first elongated channel and the end frame.

18. The method of claim 17, wherein storing the first wall panel and the second wall panel adjacent to the end frame further comprises attaching a top of the second wall panel to the spanner on the end frame with a fastener.

19. The end cap of claim 9, wherein the at least one flange of the cross support extends between the first end and the second end of the cross support.

* * * * *